United States Patent [19]

Ganzer

[11] Patent Number: 4,706,742

[45] Date of Patent: Nov. 17, 1987

[54] RAW GAS/PURIFIED GAS HEAT EXCHANGER

[75] Inventor: Winfried Ganzer, Erlangen, Fed. Rep. of Germany

[73] Assignee: Kraftwerk Union Aktiengesellschaft, Mülheim/Ruhr, Fed. Rep. of Germany

[21] Appl. No.: 865,990

[22] Filed: May 21, 1986

[30] Foreign Application Priority Data

May 24, 1985 [DE] Fed. Rep. of Germany ..... 3518842

[51] Int. Cl.[4] ..... F28F 9/22; F28D 7/00

[52] U.S. Cl. ..... 165/119; 165/160; 165/163

[58] Field of Search ..... 165/119, 160, 163

[56] References Cited

U.S. PATENT DOCUMENTS

| | | | |
|---|---|---|---|
| 1,725,322 | 8/1929 | Vezie | 165/158 |
| 2,703,225 | 3/1955 | Cooper | 165/11.1 |
| 2,967,047 | 1/1961 | Schluderberg | 165/96 |
| 3,310,104 | 3/1967 | Tilleguin | 165/145 |
| 3,406,747 | 10/1968 | White | 165/157 X |
| 3,690,374 | 9/1972 | Vollhardt | 165/163 X |
| 3,842,904 | 10/1974 | Gardenier | 165/157 X |

FOREIGN PATENT DOCUMENTS

| | | |
|---|---|---|
| 365846 | 12/1922 | Fed. Rep. of Germany . |
| 961629 | 3/1957 | Fed. Rep. of Germany . |
| 1501682 | 7/1969 | Fed. Rep. of Germany . |
| 1161500 | 9/1958 | France . |
| 653540 | 5/1951 | United Kingdom . |
| 1379168 | 1/1975 | United Kingdom . |

OTHER PUBLICATIONS

Patents Abstracts of Japan, vol. 7, No. 110, May 13, 1983.

*Primary Examiner*—Albert W. Davis, Jr.
*Assistant Examiner*—Richard R. Cole
*Attorney, Agent, or Firm*—Herbert L. Lerner; Laurence A. Greenberg

[57] ABSTRACT

Raw gas/purified gas heat exchanger, particularly for dust-laden raw gas, features heat exchanger tubes through which purified gas flows and are arranged in a substantially vertical channel which is open at the bottom and is acted upon by raw gas from above. The tubes are arranged in different two-dimensional planes extending parallel to each other and to the symmetry axis of the channel.

2 Claims, 3 Drawing Figures

RAW GAS/PURIFIED GAS HEAT EXCHANGER

BACKGROUND OF THE INVENTION

1. Field of the Invention

The invention relates to raw gas/purified gas heat exchanger, particularly for dust-loaded raw gases.

2. Description of the Prior Art

Heat exchangers are known in which hot gas, as the primary medium, heats another gas serving as a secondary medium. It is also known that the greatest possible heating of the secondary medium is achieved if the latter flows through the heat exchanger in counterflow to the primary medium. With heavily dust-laden gases such as are generated especially after powdered coal furnaces, fluidized-bed furnaces or coal gasifiers, the problem arises, however, to reduce or remove the deposits which have a detrimental effect on the heat transfer. This involves not always only deposits of soot, dust or ash particles but also, particularly behind coal gasifiers, the desublimation of $NH_4Cl$ as well as deposits which are caused by thermophoretic effects. These deposits can clog heat exchanger tubes with internal flow or if the flow is on the outside, form deposits on the heat exchanger tubes which gradually narrow down the spaces between these heat exchanger tubes and finally also clog them. These deposits decrease the heat exchange distinctly if they have a thickness of one to two millimeters.

It has been proposed to let the dust-laden raw gases flow through the heat exchanger tubes at a high flow velocity which prevents the formation of deposits in the tubes. This solution, however, requires considerable compressor power and, if the raw gas is loaded with dust, leads to erosion problems at the heat exchanger tubes and the compressors.

SUMMARY OF THE INVENTION

It is an object of the invention to develop a raw gas/-purified gas heat exchanger which is particularly well adapted to the operating conditions if heavily dust-containing raw gases are used. Also, a temperature difference as small as possible between the entering hot raw gas and the discharged secondary medium, the purified gas, is to be achieved.

With the foregoing and other objects in view, there is provided in accordance with the invention a raw gas/-purified gas heat exchanger, particularly for dust raw gas, comprising: a substantially vertical channel which is open at the bottom, a raw gas inlet line to the top of the channel for the introduction therein of the raw gas, and heat exchanger tubes through which purified gas flows disposed in the vertical channel with the tubes arranged in different two-dimensional planes extending parallel to each other and to a symmetry axis of the channel.

Other features which are considered as characteristic for the invention are set forth in the appended claims.

Although the invention is illustrated and described herein as embodied in a raw gas/purified gas heat exchanger, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings in which.

DESCRIPTION OF THE PREFERRED EMBODIMENTS

Figure 1:
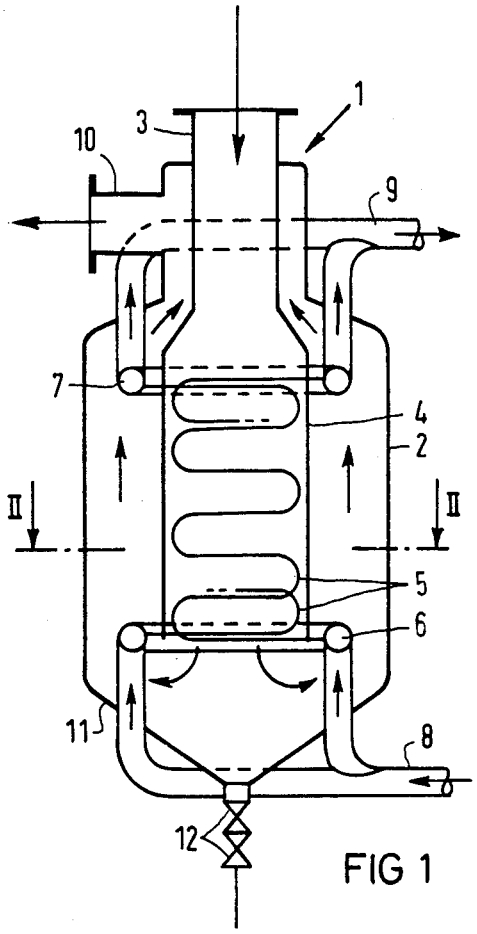
FIG. 1 diagrammatically illustrates a raw gas/purified gas heat exchanger according to the invention.

In accordance with the invention, the purified gas flows through the heat exchanger tubes and the dust-laden raw gases from the outside flow in counterflow around these heat exchanger tubes. In this manner, clogging of the narrow heat exchanger tubes is prevented without the necessity of greatly increasing the flow velocity therein to a high flow velocity. Because the heat exchanger tubes are used in a substantially vertical open channel on which the raw gas acts from above, it is assured that the largest possible amount of the dust is transported directly from the top to the bottom. At the same time the dust is prevented from accumulating in some region of the heat exchanger heating surfaces to a significant degree. Due to the fact that the heat exchanger tubes are arranged in different mutually parallel planes which are also parallel to the symmetry axis, the heat exchanger tubes may be cleaned during operation by means of soot blowers or other suitable vibrators. Also individual heat exchanger tubes which may have become defective may be replaced, unhindered by adjacent heat exchanger tubes.

If, in an advantageous further embodiment of the invention, the channel together with the heat exchanger tubes is arranged in a container which is closed on all sides and is equipped with a raw-gas discharge line at the upper end, the raw gas which passes in contact with the heat exchanger tubes in the channel is cooled-down and the cooled-down raw gas flows around the outside of the channel. As a consequence, thermal insulation to be provided to retard loss of heat through the container need be designed only for the substantially lower temperature of the cooled-down raw gas. In addition, separation due to centrifugal force of the entrained particles from the raw gas is obtained by the deflection of the raw gas by 180° at the lower open end of the channel.

A particularly simple mounting which facilitates maintenance of the heat exchanger tubes is obtained in conjunction with their installation in planes which are parallel with respect to each other and to the axis of symmetry of the channel, if, in an advantageous further embodiment of the invention, the heat exchanger tubes are connected at the lower end of the channel to an input plenum and at the upper end of the channel to a discharge plenum. In the event that one of the heat exchanger tubes is defective, the latter can then be cut off at a highly accessible point at the upper or lower end of the channel, pulled out and replaced by a new heat exchanger tube. Arrangement of the input plenum in the interior of the channel is thermally particularly advantageous. Hot flue gases flow directly over the relatively large surface of the input plenum minimizing any heat loss which can be produced in this region.

Further details of the invention are explained with reference to two embodiment examples shown in the drawings.

As seen in a FIG. 1, of the raw gas/purified gas heat exchanger 1, the raw gas input line 3 opens concentrically from above and its enlargement forms a substantially rectangular channel 4 in the interior of the pressure vessel 2 of the raw gas/purified gas heat exchanger 1. In the channel 4 of the raw gas/purified gas heat exchanger 1, the heat exchanger tubes 5 are indicated which are arranged in meander fashion and are connected at the lower, open end of the channel 4 to an entrance plenum 6 and at the upper channel to a discharge plenum 7 for the purified gas. The input plenum 6 is connected to a purified gas line 8 introducing cooler purified gas into the heat exchanger and the discharge plenum 7 is connected to a separate purified gas line 9 through which hotter purified gas is discharged from the heat exchanger. The upper end of the pressure vessel 2 of the raw gas/purified gas heat exchanger 1 shaped like a bottle surrounds the raw gas input line 3. In this region, the raw gas discharge line 10 is brought out laterally.

Figure 2:
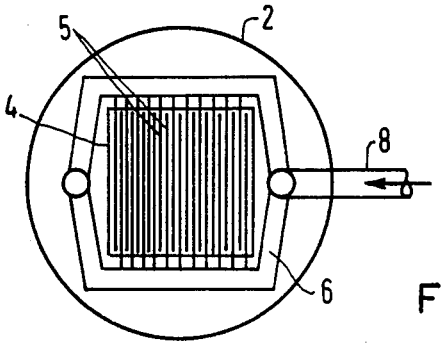
FIG. 2 is a section of the heat exchanger taken along line II—II of FIG. 1.

As is shown in the sectional view of FIG. 2, the pressure vessel 2 is cylindrical, while the channel 4, supporting the heat exchanger tubes 5, has a substantially rectangular cross section. In addition, it is seen in FIG. 2 that the heat exchanger tubes 5 are arranged in planes which are arranged parallel to the symmetry axis of the channel 4 and parallel to each other.

In the operation of the raw gas/purified gas heat exchanger 1, the hot dust-laden raw gas flows from above via the raw gas input line 3 into the channel 4 of the raw gas/purified gas heat exchanger 1. In the process, the raw gas flows past the heat exchanger tubes 5 bent in meander fashion and by contacting tubes 5 transfers heat from the raw gas to the purified gas flowing through the interior of heat exchanger tubes 5. At the lower open end of the channel 4, the raw gas is deflected by 180° as indicated by the arrows, and the raw gas then flows upwardly within the pressure vessel 2 on the outside of the channel 4 to the upper end of the raw gas/purified gas heat exchanger and then into the raw gas-discharge line 10. The sharp deflection at the lower end of the channel 4, causes particles of all kinds which have been carried along by the raw gas to be separated from the raw gas. The separated particles drop onto the funnel-shaped bottom 11 of the pressure vessel 2. The particles collecting at the bottom 11 can be drained from time to time via a known ash lock 12. The cold purified gas flowing from the purified gas line 8 into the lower input plenum 6 flows upwardly counter-current and in indirect heat exchange with the downwardly flowing hot raw gas. The cold purified gas in its passage from the lower input plenum 6 through the individual heat exchanger tubes 5 and out of them to the upper exit plenum 7 becomes warmed-up. The heated purified gas in the discharge plenum 7, is discharged from heat exchanger 1 through purified gas discharge line 9. As is shown in FIGS. 1 and 2, the input as well as the output plenums 6 and 7 are connected on opposite sides with respective purified gas input line 8 and purified gas discharge line 9.

An important advantage of the raw gas/purified gas heat exchanger 1 resides in conducting a major part of the particles brought in by the raw gas past the heat exchanger tubes 5 and separating the particles at the lower end of the channel 4 from the raw gas by the 180° deflection with the separated particles dropping into the funnel-shaped bottom 11 of the pressure vessel 2. This significantly reduces the expenditure for the dust removal. Dust particles which settle on the individual meanders of the heat exchanger tubes 5 are carried to a large extend down into funnel bottom 11 by the raw gas following in. Dust particles collecting in funnel 11 can be removed periodically through the ash lock 12. The raw gas which is substantially purified in that it is substantially free of solid particles, and cooled down to 150° can then be conducted via the raw gas discharge line 10 for further use. Furthermore, the arrangement of the heat exchanger tubes 5 without a tube sheet in two-dimensional parallel planes makes possible the unimpeded use of soot blowers and other cleaning equipment. It also permits the subsequent replacement of entire heat exchanger tubes which can be severed for this purpose at the input and the output plenum 6, 7 or welded anew.

Figure 3:
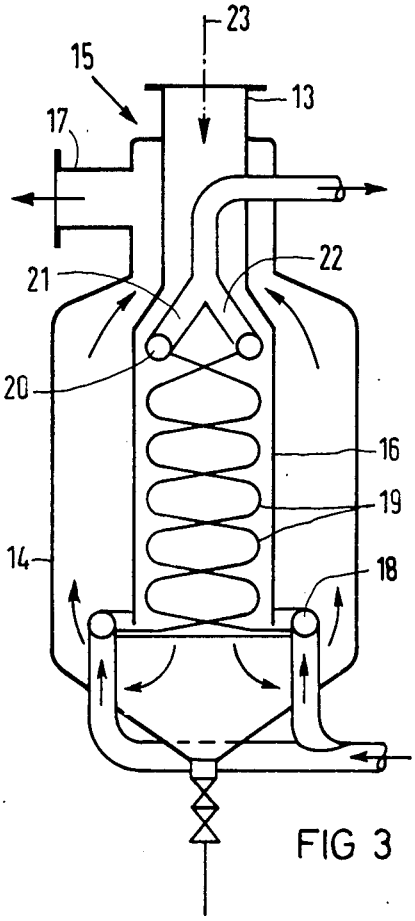
FIG. 3 is a raw gas/purified gas heat exchanger similar to that shown in FIG. 1 but in which the output plenum is relocated in the channel.

FIG. 3 shows a variation of the raw gas/purified gas heat exchanger of FIG. 1. Here, too, the raw gas input line 13 leads from above vertically into the pressure vessel 14 of the raw gas/purified gas heat exchanger 15 and the rectangular channel 16 which is arranged centered in the pressure vessel 14 is kept open at the lower end. The pressure vessel 14 also surrounds the raw gas input line 13 in the same manner as was described in connection with FIG. 1. The raw gas discharge line 17 is also connected here at the upper end of the pressure vessel 14. The design of the input plenum 18 and the arrangement of the heat exchanger tubes 19 is similar to that in the embodiment examples of FIGS. 1 and 2. The purified gas output plenum 20, however, is arranged, deviating from the embodiment example of FIG. 1, in the interior and not outside the channel 16 and thus, hot raw gas flow around it. The two stand-pipes 21, 22 on both sides of the discharge plenum 20 meet in the middle above the discharge plenum in the region of the symmetry axis 23 of the raw gas/purified gas heat exchanger 15 in the raw input line 13. The joined stand-pipes are brought out from the raw gas channel 13 with mirror symmetry with respect to the raw gas discharge line 17 and the pressure vessel 14. In this variant which has a positive effect especially in case of smaller temperature differences between the heated-up purified gas and the arriving raw gas, the heated-up purified gas in the discharge plenum 20 is prevented from giving up heat to the already cooled-down raw gas. Instead, the hot raw gas flows around the stand-pipes of the exit plenum 20.

The foregoing is a description corresponding, in substance, to German application No. P 35 18 842.1, dated May 24, 1985, international priority of which is being claimed for the instant application and which is hereby made part of this application. Any material discrepancies between the foregoing specification and the specification of the aforementioned corresponding German application are to be resolved in favor of the latter.

I claim:

1. Raw gas/purified gas heat exchanger for hot dust-laden raw gas, comprising:

(a) a substantially vertical channel which is open at the bottom (b) a raw gas inlet line to the top of the channel for the introduction therein of hot dust-laden raw gas (c) heat exchanger tubes through which purified gas flows disposed in the vertical channel with the tubes arranged in different two-dimensional planes extending parallel to each other and to a symmetry axis of the channel (d) a vessel with a funnel-shaped bottom wherein the channel together with the heat exchanger tubes are arranged, said vessel is closed on all sides is provided at the upper end of the vessel with a raw gas discharge line which surrounds the raw gas inlet line concentrically (e) an input plenum connected at the lower end of the channel to the heat exchanger tubes, and a discharge plenum connected at the other end of the channel to the heat exchanger tubes (f) an ash discharge device connected to the lowest point of the bottom of the vessel, and (g) wherein the input plenum is arranged exterior of the channel but within the vessel.

2. Raw gas/purified gas heat exchanger according to claim 1, wherein the discharge plenum is arranged exterior of the channel but within the vessel.

* * * * *